US008337918B1

(12) United States Patent
Fair

(10) Patent No.: US 8,337,918 B1
(45) Date of Patent: Dec. 25, 2012

(54) FILLABLE FILTER ENVELOPE SYSTEM

(76) Inventor: Sara E. Fair, Babson Park, FL (US)

( * ) Notice: Subject to any disclaimer, the term of this patent is extended or adjusted under 35 U.S.C. 154(b) by 393 days.

(21) Appl. No.: 12/720,383

(22) Filed: Mar. 9, 2010

Related U.S. Application Data

(60) Provisional application No. 61/209,487, filed on Mar. 9, 2009.

(51) Int. Cl.
*B65B 29/04* (2006.01)
*A47G 19/16* (2006.01)

(52) U.S. Cl. ..... 426/82; 426/83; 99/323; 99/279; 99/295

(58) Field of Classification Search ..... 426/82, 426/83; 99/323, 323.2, 279, 295, 304, 305, 99/306, 322, 323.3
See application file for complete search history.

(56) References Cited

U.S. PATENT DOCUMENTS 1,947,523 A * 2/1934 Hirschhorn ..... 426/83
2,194,451 A 3/1940 Soubier
2,359,292 A * 10/1944 Barnett ..... 426/82
3,183,096 A 5/1965 Hiscock
3,539,355 A 11/1970 Kasakoff
3,607,299 A 9/1971 Bolt
3,640,727 A 2/1972 Heusinkveld
3,716,131 A 2/1973 Ackerman
4,278,691 A * 7/1981 Donarumma et al. ..... 426/80
4,290,521 A * 9/1981 Mitchell ..... 206/0.5
4,478,858 A 10/1984 Baird et al.
4,555,894 A 12/1985 Illy
4,680,185 A * 7/1987 Illk ..... 426/83
4,800,089 A 1/1989 Scott
5,298,267 A 3/1994 Gruenbacher
5,366,741 A * 11/1994 Van Der Zon ..... 426/79
5,626,895 A * 5/1997 Gotz ..... 426/82
5,633,026 A 5/1997 Gruenbacher

* cited by examiner

*Primary Examiner* — Benjamin Layno
(74) *Attorney, Agent, or Firm* — Montgomery Patent & Design LLC; Robert C. Montgomery; Joseph Yaksich

(57) ABSTRACT

A filter envelope which is filled with ground coffee or other drinkable dry granular substance by a user and sealed for use comprises two (2) round filter media sections crimped together about a perimeter and an extended opening along one (1) edge. The user would fill the interior space of the filter with a desired amount of chosen dry granular substance through the opening. A preferred embodiment comprises the dry granular substance to comprise ground coffee for subsequent brewing within a conventional coffee machine including those such as percolators that require the filter to have a central hole.

15 Claims, 6 Drawing Sheets

FILLABLE FILTER ENVELOPE SYSTEM

RELATED APPLICATIONS

The present invention was first described in and claims the benefit of U.S. Provisional Application No. 61/209,487 filed Mar. 9, 2009, the entire disclosures of which are incorporated herein by reference.

FIELD OF THE INVENTION

The present invention relates generally to the field of small coffee makers, and in particular, to a coffee filter with novel housing and filling means.

BACKGROUND OF THE INVENTION

Coffee represents one (1) of the most highly consumed beverages in the world. In addition, much coffee is produced by means of small personal coffee machines due to the facts that personal preferences vary greatly and that coffee is often consumed early in the morning and in small quantities. Conventional coffee makers require a user to load a filter and a desired amount of coffee grounds every time a new pot of coffee is to be brewed. However, this process often leads to inconveniences and messes related to the collapsing of the filter, spilling of the grounds, and the like.

Various attempts have been made to provide various types of coffee filters for low volume batches of coffee. Examples of these attempts can be seen by reference to several U.S. patents. U.S. Pat. No. 3,539,355, issued in the name of Kasakoff, describes a coffee filter bag which provides a sealed bag-type enclosure for a volume of coffee.

U.S. Pat. No. 4,478,858, issued in the name of Baird et al., describes a conventional "instant coffee" type packet and a method of production, which contains a sealed and pre-packaged amount of coffee for quick and convenient usage by a consumer.

U.S. Pat. No. 5,298,267, issued in the name of Gruenbacher, describes a coffee filter pack with added provisions to make the filter self-aligning within the coffee maker and to provide enhanced water-to-coffee contact for high efficiency brewing.

While these devices fulfill their respective, particular objectives, each of these references suffer from one (1) or more of the aforementioned disadvantages. Many such devices do not provide features to help eliminate messes associated with conventional brewing procedures. Also, many such devices do not allow a user to select the type or amount of coffee to be brewed according to volume requirements and personal preference. Furthermore, many such devices do not provide the user with a means to easily and cleanly fill the device for use with a conventional coffee maker. Accordingly, there exists a need for a coffee filter envelope without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a coffee filter envelope which provides secure containment of coffee grinds in order to prevent messes and which also allows a user to easily and selectively fill the device. Thus, the object of the present invention is to solve the aforementioned disadvantages and provide for this need.

To achieve the above objectives, it is an object of the present invention to comprise a dual layer filter media which further comprises a first side and second side. The two (2) sides are the same size and shape and attached to each other along a perimeter edge via an adhesive and a common crimped edge.

Another object of the present invention is for the adhesive to comprise a non-toxic bonding material which seals the sides together to form a generally circular main body and an extended opening.

Yet still another object of the present invention is for the main body of a housing to comprise a storage area for a dry granular substance such as coffee grinds. The substance is introduced by a user into the housing by means of the extended opening.

Yet still another object of the present invention is to comprise a distal end of the extended opening of a filling aperture as defined by an opening between the first and second sides.

Yet still another object of the present invention is to comprise a conventional funnel with features such as a large mouth, a conical shape, and a tapering narrow stem. The funnel is sized to fit inside the filling aperture, providing a user with a simple means of introducing coffee grinds or the like into the interior of the device.

Yet still another object of the present invention is to provide an alternate embodiment in which the extended portion and filling aperture are located at a top center face of the device, as opposed to a perimeter edge location.

Yet still another object of the present invention is to allow a method for sealing the invention to comprises a user to fold the extended portion of the device after filling in order to seal the dry granular material inside the main body. In this manner, the device may be utilized with an existing coffee machine in a conventional manner without risk of spilling the contents of the device.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
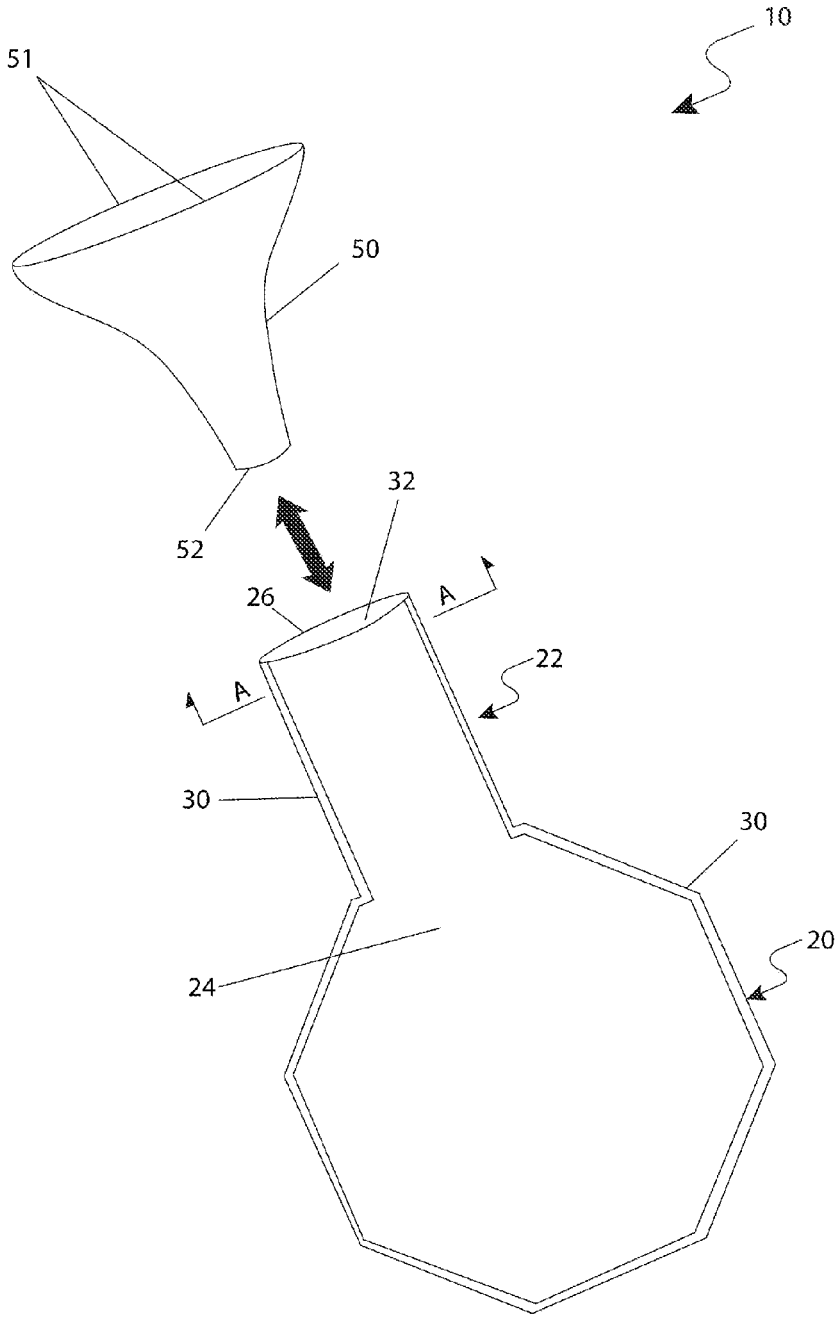
FIG. 1 is a top perspective view of a filter envelope 10 depicted in a loading state, according to a preferred embodiment of the present invention.

10 filter envelope
20 main body
22 extended opening
24 first side
26 second side
28 twisted portion
30 crimped edge
31 adhesive
32 filling aperture
50 funnel
51 mouth
52 stem
100 filter with center opening
120 alternate main body
122 alternate extended opening
124 alternate first side
126 alternate second side
150 center opening
152 center opening crimped perimeter

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a filter envelope (herein described as the "device") 10, which provides a means and a method for a user to package a personalized type and amount of a drinkable dry granular substance, such as, but not limited to: coffee, tea, or a mixture of the like for conventional brewing. These filter media units would be packaged together and sold to the consumer in an empty state. Upon purchase, the user would fill the interior space of the device 10 with a desired amount of chosen dry granular substance through an extended opening 32. Once filled, the extended opening 32 would be folded and tucked under the device 10 and utilized for brewing or stored in a preferably airtight container until use. The device 10 is preferably introduced in various sizes and designs to accommodate use with standard coffee makers, personal coffee makers, and percolators. The device 10 provides several benefits, such as saving time during measuring out coffee, eliminating the possibility of the granular substance spilling into the finished beverage, and easy and quick cleaning.

Figure 2:
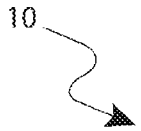
FIG. 2 is a section view of the filter envelope 10 taken along line A-A (see FIG. 1), according to a preferred embodiment of the present invention.
Figure 2:
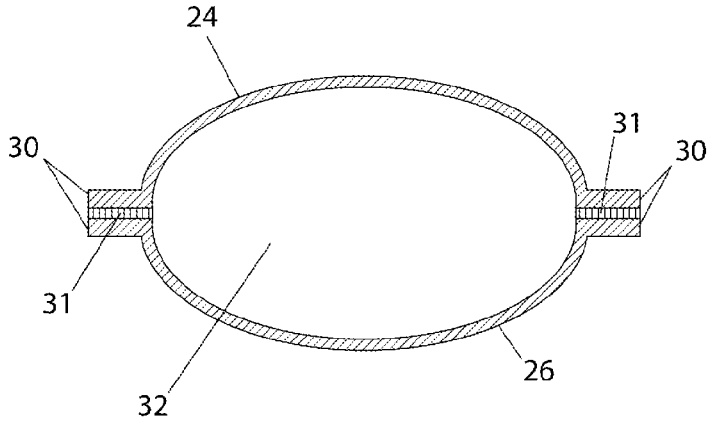

Referring now to FIG. 1, a top perspective view of the device 10 depicted in a loading state and FIG. 2, a section view of the device 10 taken along line A-A (see FIG. 1), according to the preferred embodiment of the present invention, are disclosed. The device 10 is comprised of a dual layered pancake-style filter media further comprising a first side 24 and a second side 26. The first side 24 and the second side 26 are of equivalent size and shape. The first side 24 and the second side 26 are preferably made of an appropriate filter media such as paper which allows water, oils, flavor saturated liquid, and the like to pass therethrough. The sides 24, 26 are attached to each other along a perimeter edge via an adhesive 31 and a common crimped edge 30 which further seals the perimeter edges of the sides 24, 26 together. The adhesive 31 is preferably a non-toxic bonding material which bonds an underside perimeter edge of the first side 24 to an upper perimeter edge of the second side 26. Once sealed the sides 24, 26 form a generally circular main body 20 and an extended opening 22. The main body 20 provides the main housing and storage area for the dry granular substance which is inserted thereinto via the extended opening 22. The device 10 is preferably introduced comprising various main body 22 sizes to accommodate usage of said device 10 with regular coffee machines, small personal coffee machines, and the like. The outline and shape of the device 10 is defined by on the outer crimped edge 30, thereby further bonding the sides 24, 26 together.

The device 10 further comprises a filling aperture 32 located thereon a distal end of the extended opening 22 which is defined by the opening therebetween the first side 24 and the second side 26. The filling aperture 32 is utilized to fill the device 10 with a desired dry granular substance via a funnel 50. The funnel 50 comprises conventional features such as a mouth 51 and a stem 52, thereby enabling the user to channel the desired dry mixture into the device 10 via the filling aperture 32. The mouth 51 is conical in shape and the stem 52 is a tapering narrow extension of said mouth 51. The stem 52 is appropriately sized to fit thereinside the filling aperture 32 thus making filling and packaging simpler and cleaner. The funnel 50 is fabricated from materials such as, but not limited to: plastic, stainless steel, or the like.

Figure 3:
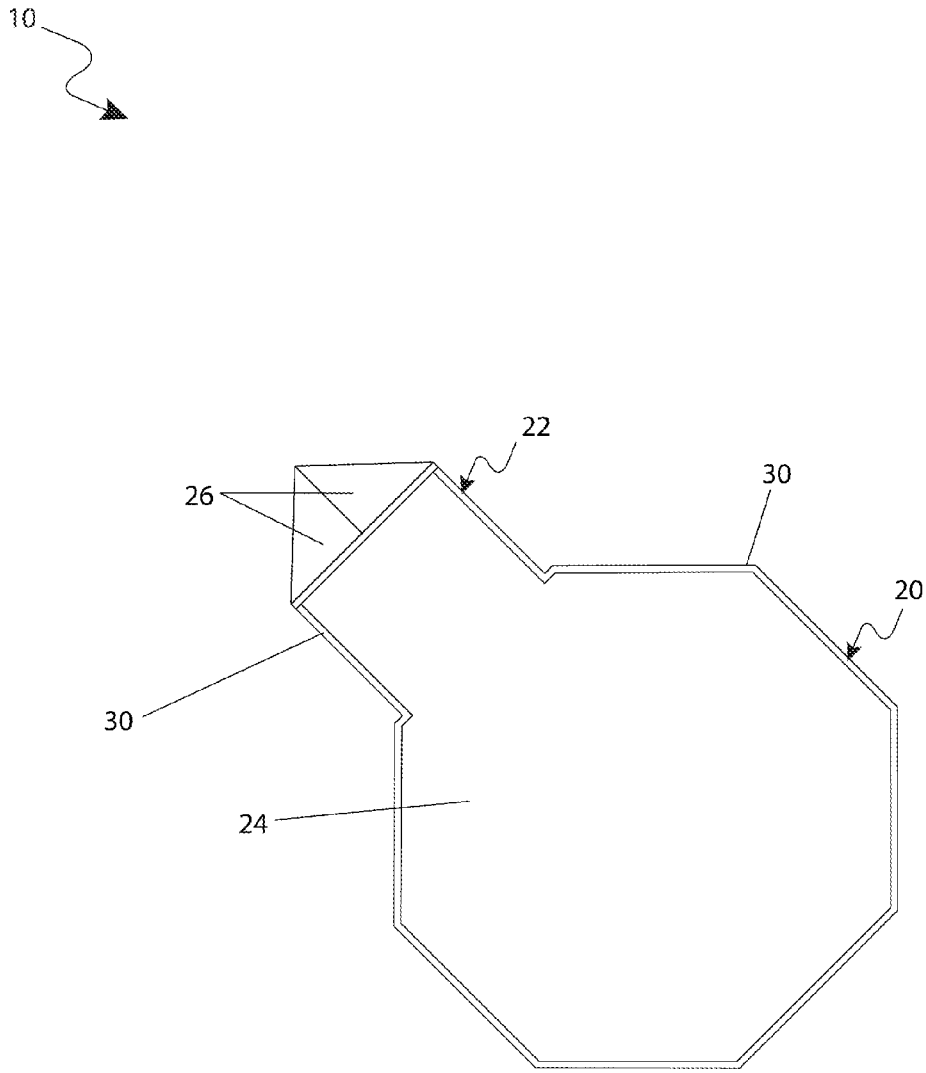
FIG. 3 is a top view of the filter envelope 10 depicting a first state of a folding configuration, according to a preferred embodiment of the present invention.
Figure 4:
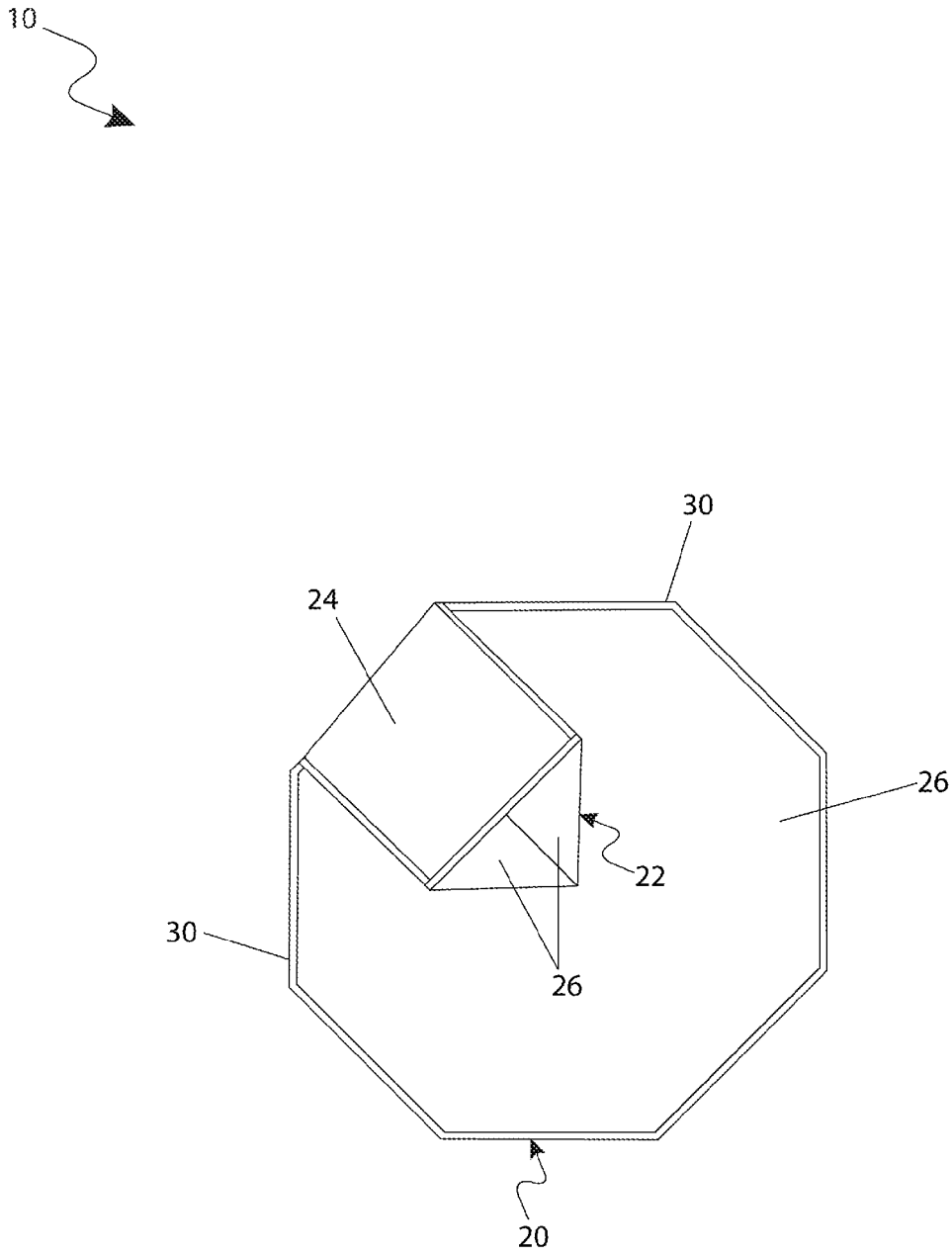
FIG. 4 is a top view of the filter envelope 10 depicting a second state of a folding configuration, according to a preferred embodiment of the present invention.
Figure 5:
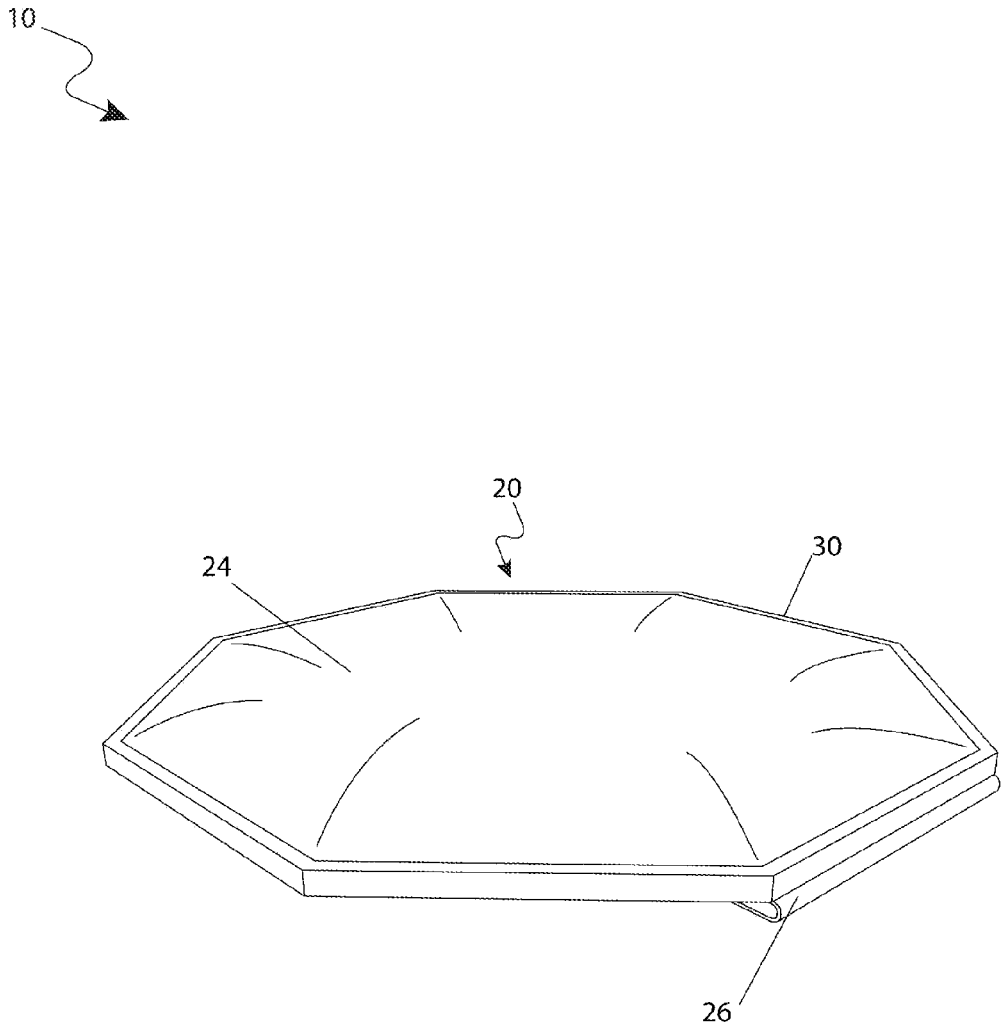
FIG. 5 is a perspective view of the filter envelope 10 depicting a fully loaded state, according to a preferred embodiment of the present invention; and, FIG. 6 is a top perspective view of a filter envelope with a center opening 100 depicted in a loading state, according to an alternate embodiment of the present invention.

Referring now to FIGS. 3 through 5, various views of the device 10 depicting prepared states, according to the preferred embodiment of the present invention, are disclosed. FIG. 3 illustrates a top view of the device 10 depicting a first state of a folding configuration, FIG. 4 illustrates another top view of the device 10 depicting a second state of a folding configuration, and FIG. 5 illustrates a perspective view of the device 10 depicting a fully loaded state. After the main body 20 has been filled with a desired amount and mixture of dry granular substance the device 10 may be sealed and prepared for use with an existing coffee machine. In a first state the user is to fold an upper portion of the extended opening 22 into a pair of opposing valley folds which creates a triangular-shape. In the second state the extended portion 22 is then tucked beneath the now packaged main body 20 positioned subjacent to the second side 26. The folding of the extended portion 22 provides a means of sealing the filling aperture 32 and maintaining a secure enclosure for the dry granular substance thereinside the main body 20. Although depicted as creating a triangular folded sealing means it is known that other means of securing the extended portion 22 may be utilized without limiting the scope of the device 10.

Figure 6:
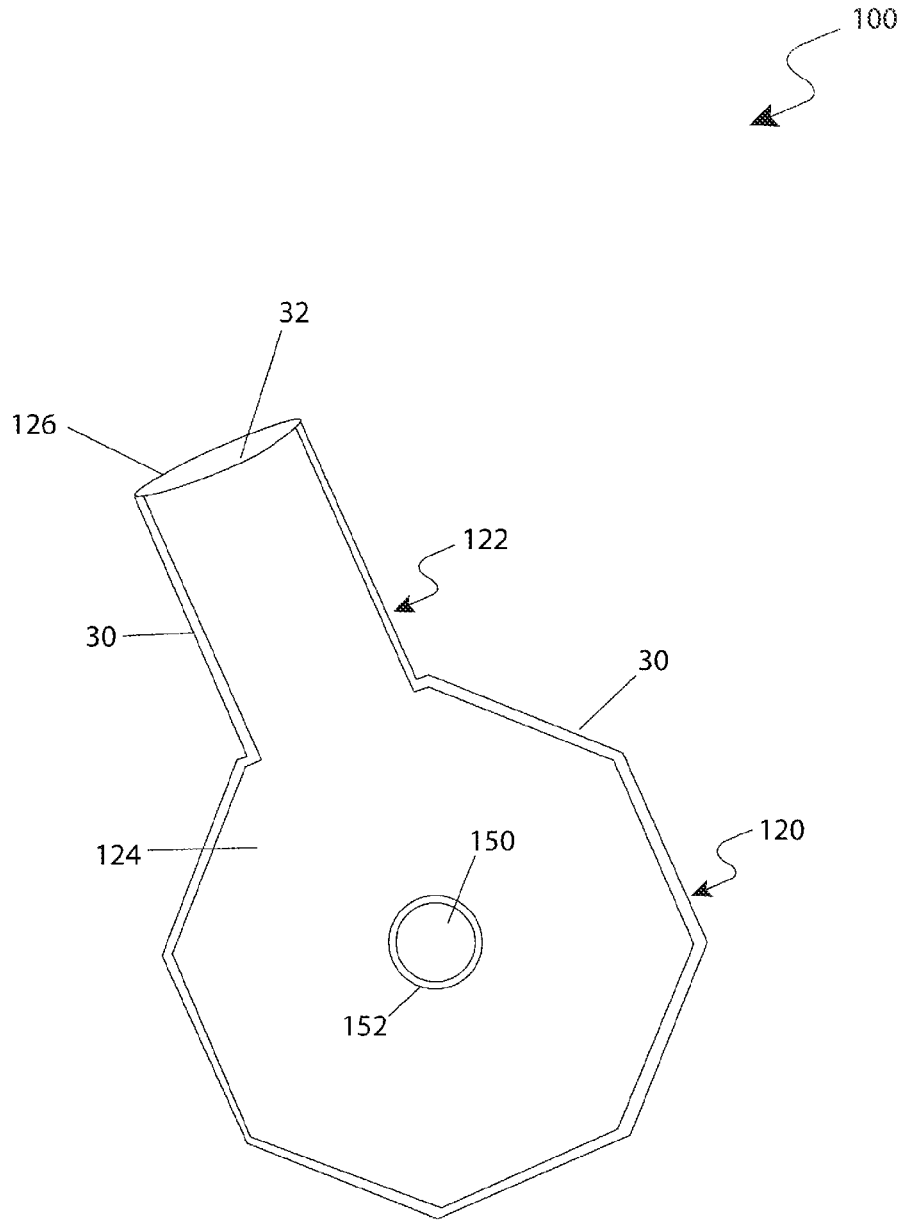

Referring now to FIG. 6, a top perspective view of a coffee filter envelope with a center opening 100 depicted in a loading state, according to an alternate embodiment of the present invention, is disclosed. The coffee filter envelope with a center opening 100 comprises substantially similar features, materials, and functions to that of the preferred device 10 with the particular distinction of comprising a circular center opening 150. The filter envelope with a center opening 100 is to accommodate usage with regular and large size percolator type coffee makers. The coffee filter envelope with a center opening 100 comprises an alternate main body 120 and an alternate extended opening 122 which are formed via the attachment of an alternate first side 124 thereto an alternate second side 126. The sides 124, 126 are to be crimped and sealed along a crimped outer edge 30 and each comprise a center opening 150 therein the center of the portion which makes up the alternate main body 120. The alternate first and second sides 124, 126 further comprise a center opening crimped perimeter 152 which is crimped and sealed with a non-toxic adhesive or the like thus sealing the center opening 150.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1 and alternately in FIG. 6.

The method of utilizing the device 10 may be achieved by performing the following steps: retrieving a device 10 and an amount of dry granular substance, such as coffee, tea, or the like; inserting the stem 52 of the funnel 50 into the extended opening 22; pouring a desired amount of granular substance thereinto the mouth 51 of the funnel 50, thereby filling the main body 20 with the granular substance; creating a pair of opposing valley folds on an upper portion of the extended opening 22; tucking the extended opening 22 under the main body 20 positioning the said extended opening 22 subjacent to the second side 26; inserting said device 10 thereinto the coffee filter housing of a standard coffee maker; using said coffee maker in a normal manner; discarding said used device 10; and, benefiting from the increased efficiency, personalization, and ease of use afforded a user of the present device 10.

The method of utilizing the coffee filter with center opening 100 may be achieved by performing substantially the same abovementioned steps as those described for the preferred embodiment of the device 10 and used for percolator style coffee makers.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A system for customizable filling of a filter envelope with an amount of a dry drinkable substance, comprising:

said filter envelope comprising a dual-layered filter media and a filling aperture, further comprising:

a main body, comprising a first side having a first inner surface with a first perimeter edge bonded to a second inner surface with a second perimeter edge of a second side, thereby defining an interior in fluid communication with said filling aperture; and, an opening, comprising coextensive portions of said first side and said second side extending away from said main body and terminating in a non-bonded front opening defining said filling aperture;

a funnel for providing a filling means for said dry drinkable substance therein said filter envelope; and, a sealing means for securing said dry drinkable substance within said filter envelope via said sealing means;

wherein a user fills said filter envelope with said amount of dry drinkable substance therein; and, wherein said filter envelope filled with said dry drinkable substance therein is processed to provide a drinkable beverage.

2. The system of claim 1, wherein said filter envelope is adapted for use in a conventional coffee machine.

3. The system of claim 1, wherein said first side and said second side are bonded by an adhesive and a crimped edge.

4. The system of claim 1, wherein said sealing means further comprises a pair of valley folds formed by a folded upper portion of said extended opening of said first side and motioned underneath said second side.

5. The system of claim 1, wherein said filter envelope comprises dimensions enabling use within a percolating coffee machine.

6. The system of claim 5, wherein said filter envelope further comprises:

a main body with a circular center opening, comprising a first side having a first inner surface with a first perimeter edge bonded to a second inner surface with a second perimeter edge of a second side and a first center aperture of said first inner surface bonded to a second center aperture of said second inner surface, thereby defining said interior; and, an extended opening comprising a non-bonded front opening defining said filling aperture in fluid communication with said interior.

7. The system of claim 6, wherein said first side and said second side are bonded by an adhesive and a crimped edge.

8. The system of claim 6, wherein said sealing means further comprises a pair of valley folds formed by a folded upper portion of said extended opening of said first side and motioned underneath said second side.

9. The system of claim 1, wherein said funnel comprises a conical mouth in fluid communication with a hollow stem;

wherein said stem of said funnel is sized to fit within said filling aperture.

10. A method for filling a filter envelope with a dry granular substance for use within a coffee machine comprises the following steps:

providing said filter envelope further comprising:

a main body, comprising a first side having a first inner surface with a first perimeter edge bonded to a second inner surface with a second perimeter edge of a second side, thereby defining an interior; and, an opening comprising coextensive portions of said first side and said second side extending away from said main body and terminating in a non-bonded front opening defining a filling aperture in fluid communication with said interior;

obtaining an amount of a desired dry drinkable substance;

filling said filter envelope by directing said dry drinkable substance into said interior through said filling aperture; and, sealing said filling aperture.

11. The method of claim 10, wherein said step of filling said filter envelope with said dry drinkable substance is accomplished with a funnel.

12. The method of claim 10, wherein said step of sealing said filling aperture comprises the following steps:

creating a pair of opposing valley folds on either side first side or said second side of said extended opening; and, tucking said extended opening on an opposite side of said pair of opposing valley folds.

13. A method for filling a filter envelope with a dry granular substance for use within a percolator-style coffee machine comprises the following steps:

providing said filter envelope having a center opening, further comprising:

a main body, comprising a first side having a first inner surface with a first perimeter edge bonded to a second inner surface with a second perimeter edge of a second side and a first center aperture of said first inner surface bonded to a second center aperture of said second inner surface, thereby defining an interior;

an opening comprising coextensive portions of said first side and said second side extending away from said main body and terminating in a non-bonded front opening defining a filling aperture in fluid communication with said interior;

obtaining an amount of a desired dry drinkable substance;

filling said filter envelope by directing said dry drinkable substance into said interior through said filling aperture; and sealing said filling aperture.

14. The method of claim 13, wherein said step of filling said filter envelope with said dry drinkable substance is accomplished with a funnel.

15. The method of claim 13, wherein said step of sealing said filling aperture comprises the following steps:

creating a pair of opposing valley folds on either side first side or said second side of said extended opening; and, tucking said extended opening on an opposite side of said pair of opposing valley folds.

* * * * *